US007900321B2

(12) United States Patent
Fitz et al.

(10) Patent No.: US 7,900,321 B2
(45) Date of Patent: Mar. 8, 2011

(54) DAMPER ARRANGEMENT

(75) Inventors: Helmut Fitz, Lustenau (AT); Harald Sutterlütti, Fussach (AT)

(73) Assignee: Julius Blum GmbH, Höchst (AT)

( * ) Notice: Subject to any disclaimer, the term of this patent is extended or adjusted under 35 U.S.C. 154(b) by 0 days.

(21) Appl. No.: 11/785,846

(22) Filed: Apr. 20, 2007

(65) Prior Publication Data

US 2007/0220705 A1 Sep. 27, 2007

Related U.S. Application Data

(63) Continuation of application No. PCT/AT2005/000306, filed on Aug. 2, 2005.

(30) Foreign Application Priority Data

Oct. 21, 2004 (DE) ..... 20 2004 016 396 U

(51) Int. Cl.
*E05D 15/00* (2006.01)

(52) U.S. Cl. ..... 16/362; 16/82; 16/50

(58) Field of Classification Search ..... 16/286, 16/277, 362, 82, 83, 84, 288, 374, 375, 85, 16/86 R, 86 A, 86 B, 86 C, 50; 188/297
See application file for complete search history.

(56) References Cited

U.S. PATENT DOCUMENTS

| | | | | |
|---|---|---|---|---|
| 3,564,643 | A | 2/1971 | Salice | |
| 3,621,508 | A * | 11/1971 | Noia et al. | 16/82 |
| 3,763,519 | A * | 10/1973 | Favre | 16/72 |
| 6,789,293 | B2 * | 9/2004 | Habegger et al. | 16/374 |
| 6,986,187 | B2 * | 1/2006 | Cummins et al. | 16/286 |
| 7,275,284 | B2 * | 10/2007 | Lautenschlager et al. | 16/287 |
| 7,406,749 | B2 * | 8/2008 | Herper | 16/286 |
| 7,600,295 | B2 * | 10/2009 | Zimmer | 16/286 |
| 2003/0200625 | A1 * | 10/2003 | Zimmer | 16/306 |
| 2004/0201154 | A1 * | 10/2004 | Salice | 267/205 |

FOREIGN PATENT DOCUMENTS

| | | |
|---|---|---|
| DE | 195 39 260 | 4/1996 |
| DE | 299 13 854 | 11/1999 |
| DE | 299 10 626 | 2/2000 |
| DE | 202 00 762 | 5/2002 |
| DE | 203 05 835 | 7/2003 |
| EP | 1 217 159 | 6/2002 |
| EP | 1 359 275 | 11/2003 |
| EP | 1 375 797 | 1/2004 |
| EP | 1 555 372 | 7/2005 |
| WO | 03/004817 | 1/2003 |
| WO | 2004/092516 | 10/2004 |

* cited by examiner

*Primary Examiner* — Victor Batson
*Assistant Examiner* — Jeffrey O'Brien
(74) *Attorney, Agent, or Firm* — Wenderoth, Lind & Ponack, L.L.P.

(57) ABSTRACT

A damping arrangement, in particular for displaceable furniture parts, includes a damper (1) which is provided with a tappet (2) which can be impinged upon, and which can be supported by a support element (3). The support element (3) can be positioned and/or displaced in relation to the tappet (2).

19 Claims, 6 Drawing Sheets

DAMPER ARRANGEMENT

This application is a continuation of International Application No. PCT/AT2005/000306, filed Aug 2, 2005.

The present invention concerns a damper, especially for movable furniture parts, with a damper with a ram which can be subjected to pressure and which is supportable on a support element.

There are an enormous variety of dampers known in the state of the art, for example for use in movable furniture parts. These can be designed both as linear and as rotation dampers. They normally have a path-dependent damping function. This means that the degree of damping depends on how far the ram is pushed in or pulled out. In the state of the art, the ram comes into contact with a support element at the start of the damping movement, if it is not originally already permanently connected to this. The course of the damping movement is then fixed by the characteristics of the damper per se and the geometrical arrangement of damper and support element.

The object of the invention is to be able further to influence the damping function of the damper arrangement of the generic type.

This is achieved according to the invention by the fact that the support element is displaceable or slidable in its position relative to the ram.

The start, the course and the end of the damping process can additionally be influenced by the displaceable or slidable support element. When dampers with a path-dependent damping function are used, this then automatically results in an effect on the instantaneous damping value as a function of the position relative to each other of those movable furniture parts on which the damper arrangement is affixed.

It is usually desirable in that case if the ram meets the support surface on the support element assigned to it before it reaches the furniture part, fitting element, articulated lever or suchlike. This causes the damper to take effect at an earlier stage. Moreover, the ram can also be pressed into the damper more quickly than would be possible without the support element. Normally, the support area of the support element will thus be arranged between the ram and the fitting elements, articulated levers, furniture parts or suchlike arranged behind it—at least during the active damping process. It is, however, also possible by a corresponding recessed arrangement of the support element to achieve a later activation of the damper, to reduce the stroke or suchlike.

In principle, there are two possible variants in this case. The first of these makes provision that the support element is movable between a first and at least one second end position by means of a movement of the damper arrangement. In this embodiment, the support element moves automatically each time in the same way while the damper arrangement is in operation, so that the damping function of the damper used is always influenced in the same way. This variant is especially advantageous when the damping function of a fabricated damper is to be modified for a special application.

In a second group of variant embodiments of the invention, however, provision may also be made that the damper arrangement provides an adjustment device, preferably an adjustment screw, which enables the support element to be fixed in various positions relative to the ram. The support element can be fixed in various positions by the adjustment device, as the result of which a preferably manual adaptation is possible. This can be used, for example, in hinges with a damper arrangement according to the invention, to reverse a change in the damping path of the damper caused by a joint adjustment screw and/or a depth adjustment screw, in order thereby to ensure a constant damping function.

DESCRIPTION OF THE DRAWINGS

Further features of the invention are explained with the aid of the following description of some embodiments. The figures show.

DETAILED DESCRIPTION OF PREFERRED EMBODIMENTS

Figure 1:
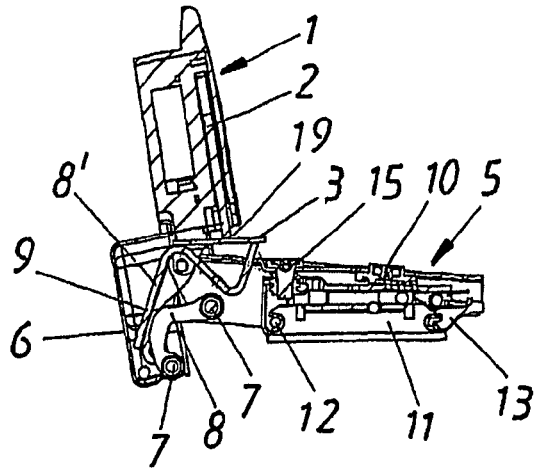
FIGS. 1 to 3: a first embodiment according to the invention.
Figure 2:
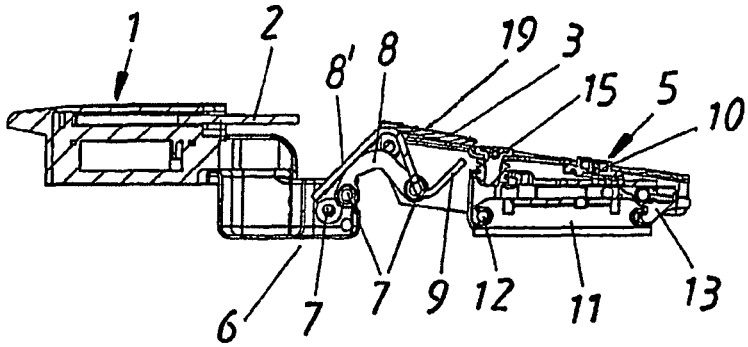
Figure 3:
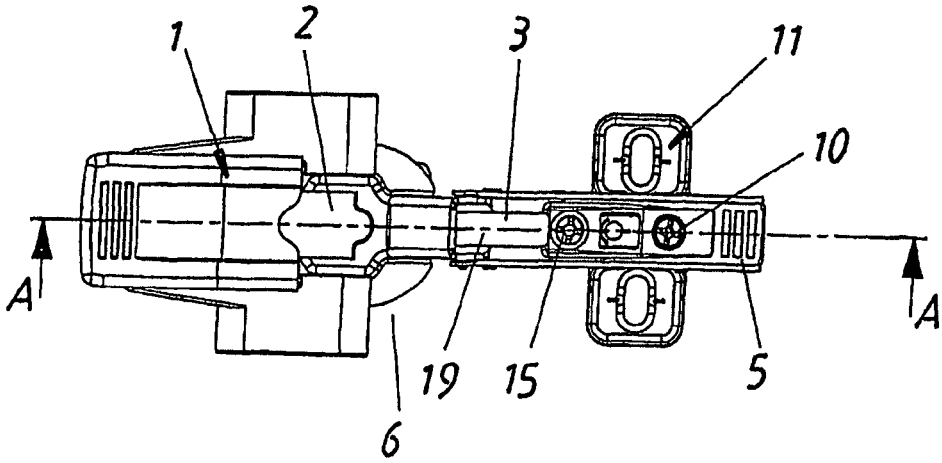

The embodiment according to FIGS. 1 to 3 shows an inventive damper arrangement which is integrated into a furniture hinge with hinge arm 5 and hinge cup 6 as fitting elements. The damper 1 in this embodiment is arranged on the hinge cup 6. It has a ram 2 which travels in and out, preferably with a path-dependent damping function. The hinge arm 5 of the hinge 1 shown can, as known in the state of the art, be clipped onto a base plate 11 via a hook-on device 12 and a snap closure 13. A joint adjustment screw 15 and a depth adjustment device 10 are provided as known in the art to adjust the relative position between hinge cup and hinge arm. Hinge arm 5 and hinge cup 6 are linked by articulated levers 8 and 8' which are arranged on articulated axles 7. According to the present invention, a movable support element 3 is now provided. In this embodiment, the support element 3 is rotatably mounted on the hinge arm 5, thus on one of the two fitting elements of the hinge. In addition, a coupling lever 9 is provided which is also rotatably mounted on the hinge arm 5. In this embodiment the coupling lever 9 is integrated into the outer articulated lever 8'. However, it may also be designed as a separate lever in addition to the articulated lever or levers 8, 8'.

Figure 4:
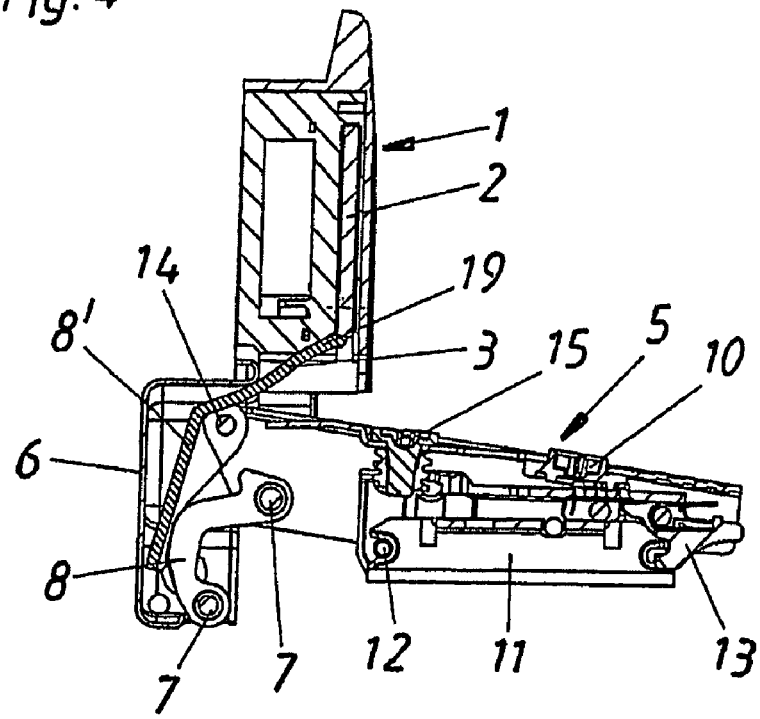
FIGS. 4 and 5: a second embodiment according to the invention.
Figure 5:
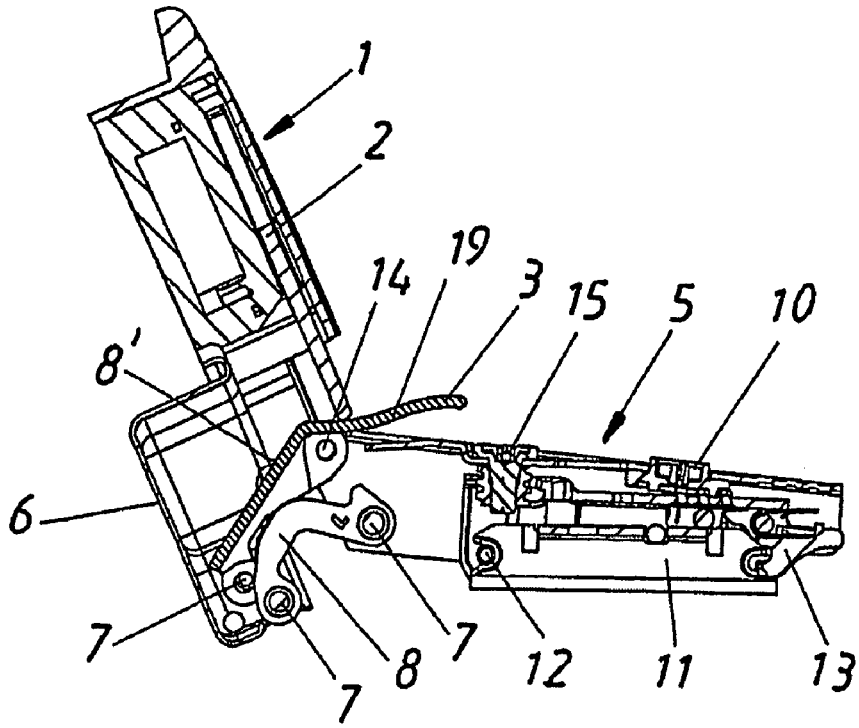

FIG. 2 shows a section along the straight line AA from FIG. 3 through the inventive arrangement, where hinge cup 6 and hinge arm 5 can be seen in the folded-out position. When moving into the position shown in FIG. 1, the coupling lever 9 is pivoted relative to the arm 5. As a result, the coupling lever 9 moves the support element 3 from the position shown in FIG. 2 to that shown in FIG. 1. During the closing movement, the ram 2 comes into contact with the support element 3. By raising the support element 3, this contact occurs earlier than if the ram 2, as known in the state of the art, were to rest directly on the hinge arm 5. So the ram 2 is pushed sooner and then deeper into the cylinder of the damper 1, as the result of which, especially in dampers with path-dependent damping function, the damping value assigned to a certain angle of incidence between the fitting elements increases in each case. The coupling lever 9 in this embodiment is essentially z-shaped, but can take any other form, depending on the geometry of the damper arrangement. While in the first embodiment the coupling lever 9 is arranged such that it converts a movement of the articulated lever 8' into a movement of the support element 3, the second embodiment according to FIGS. 4 and 5 has an inventive arrangement in which the support element 3 itself is integrated into the articulated lever 8'. The support element 3 can—in an embodiment not shown here—also alternatively be pivotably mounted on the hinge arm 5 and acted upon by the hinge cup 6, without being integrated into an articulated lever 8, 8'. The form of the support element 3 and, if applicable, of the coupling lever 9 specifies in the embodiments from when, and how far, the ram 2 is pressed into the damper 1 at the respective pivoting angles between hinge cup 6 and hinge arm 5, as the result of which, in turn, the angle-dependent damping function is influenced.

Figure 6:
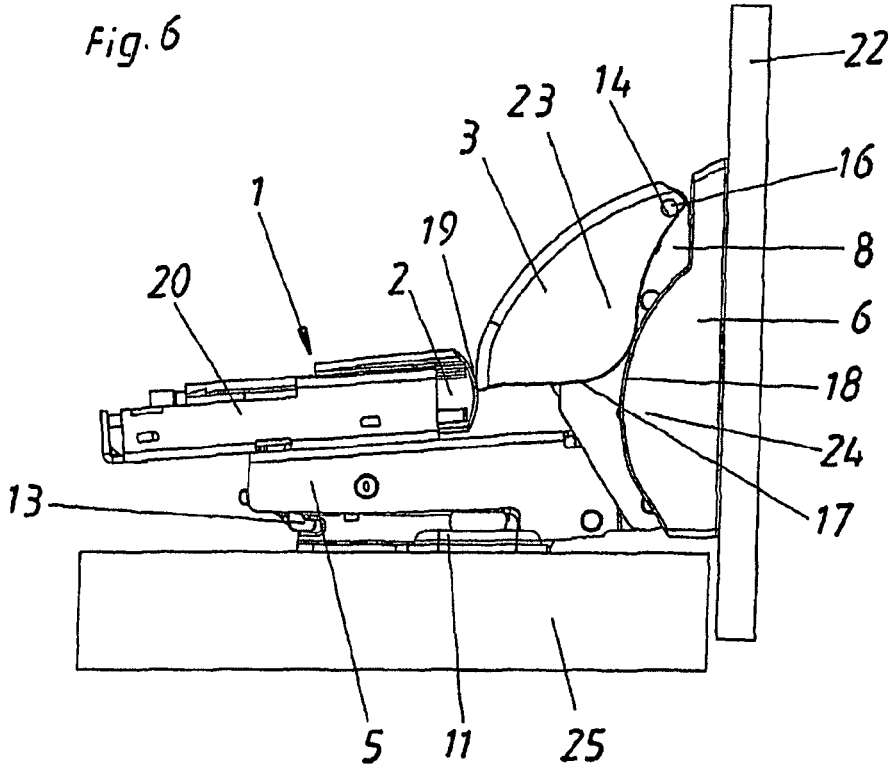
FIGS. 6 to 8: a third embodiment according to the invention.
Figure 7:
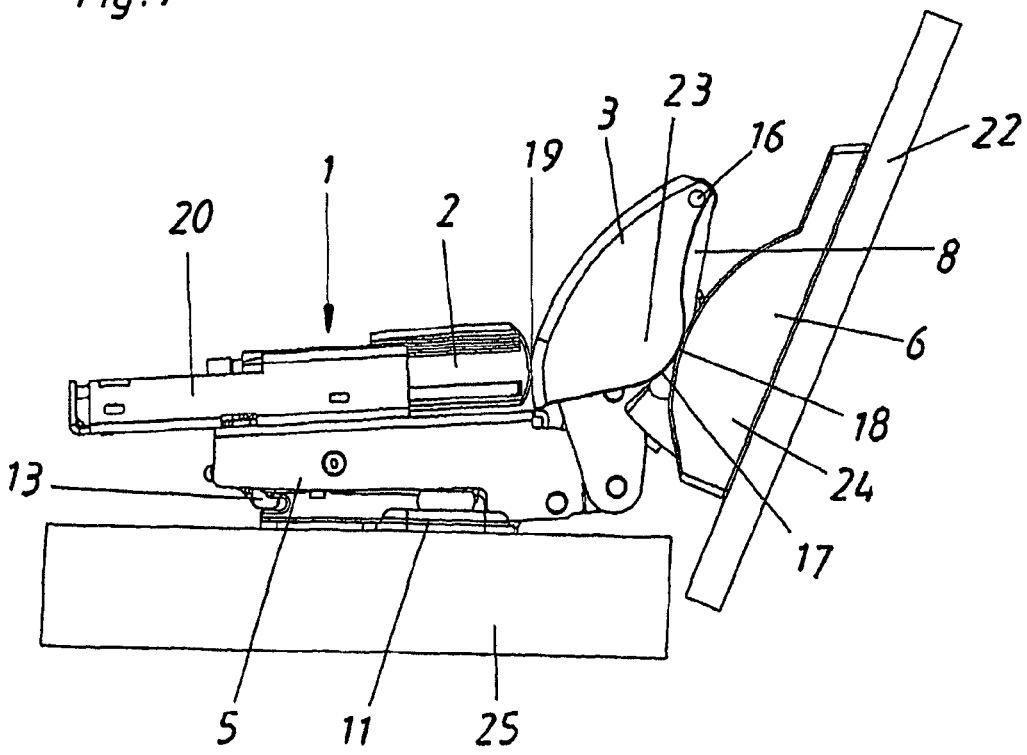
Figure 8:
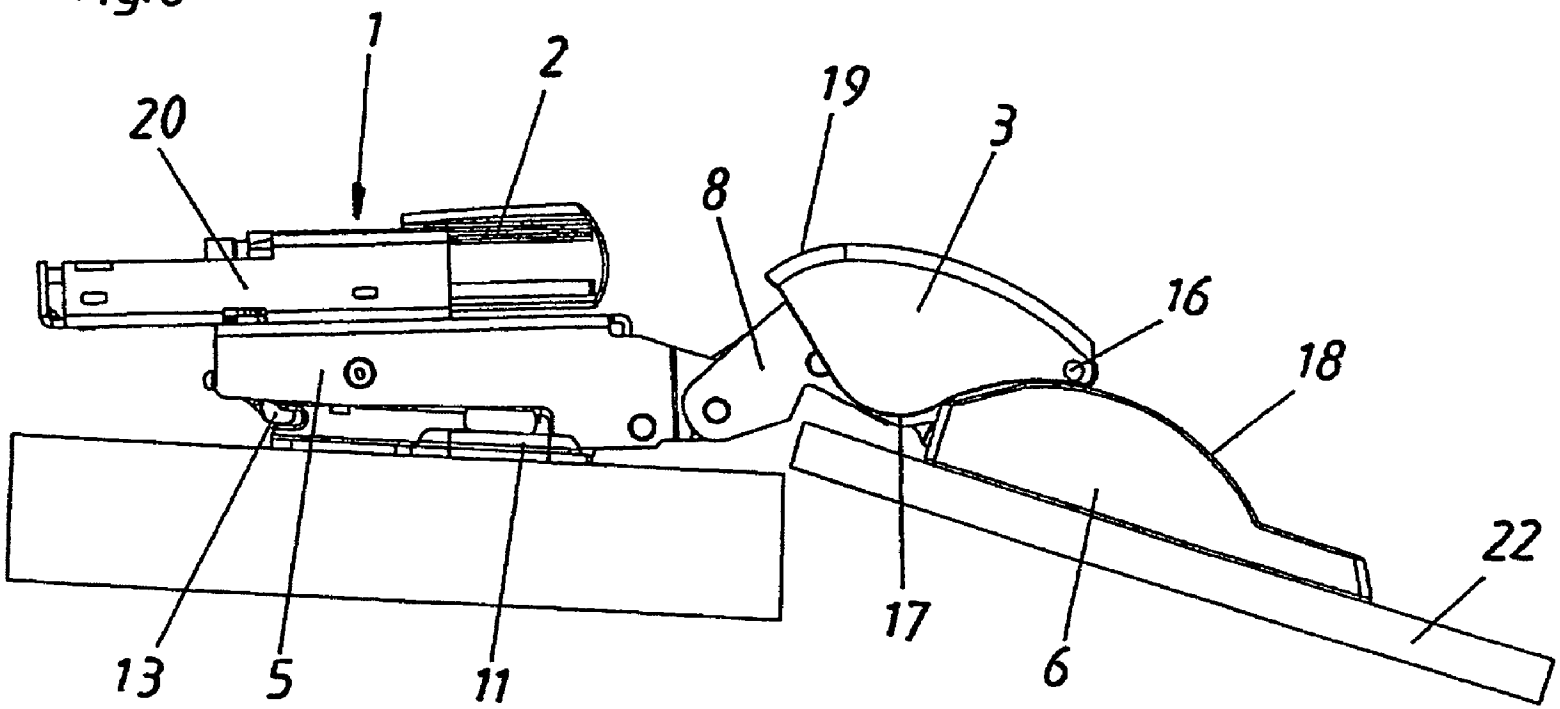
Figure 9:
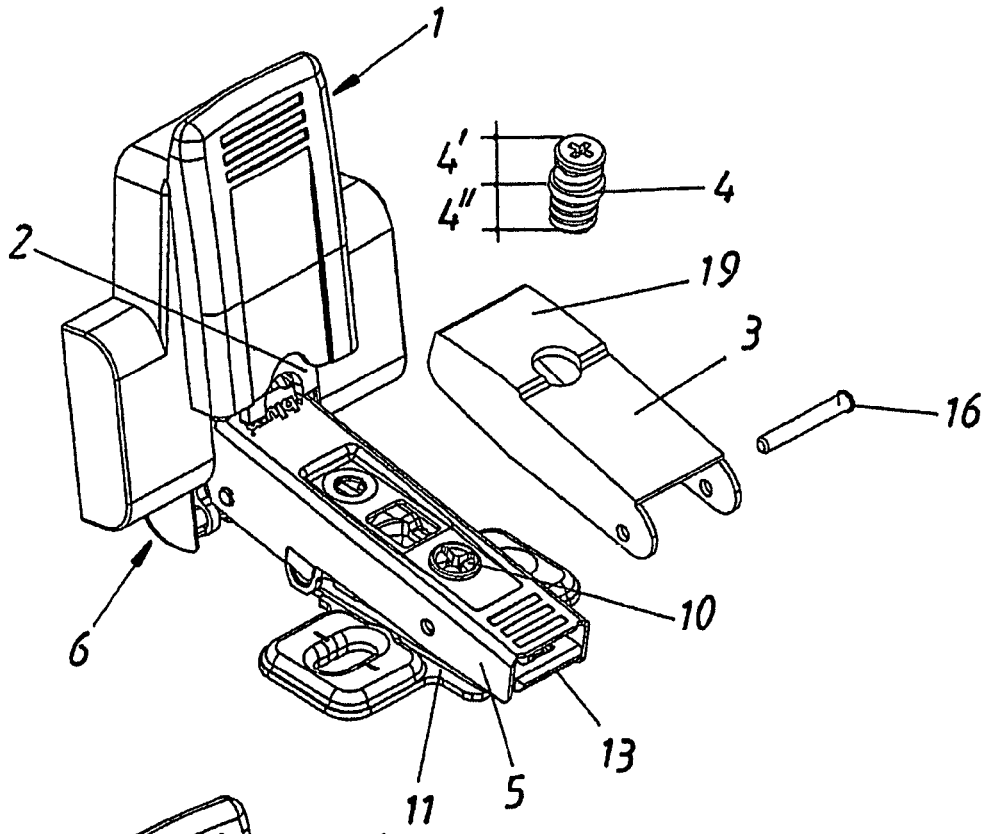
FIGS. 9 to 12: a fourth embodiment according to the invention.
Figure 10:
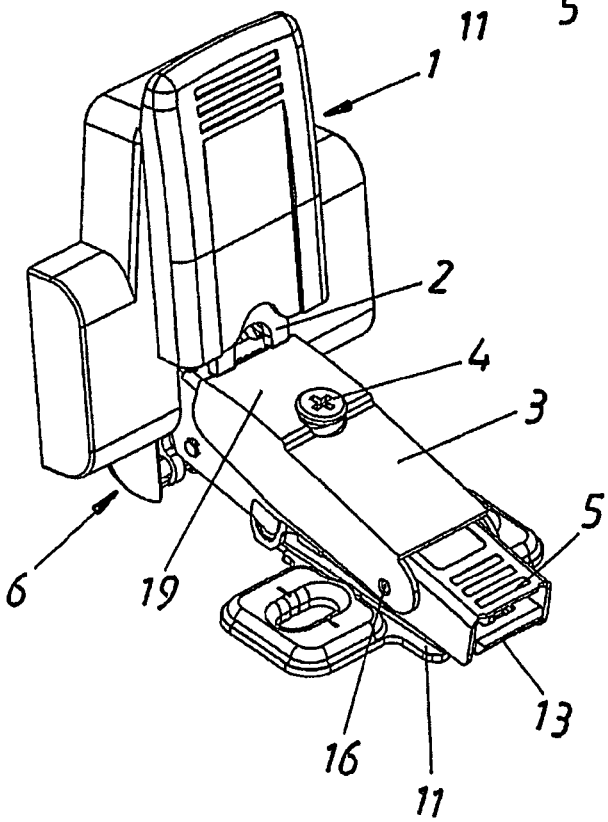

In the third. embodiment according to FIGS. 6 to 8, the housing 20 of the damper 1 is anchored on the hinge atm 5. The support element 3 forms a cover with a cross-section in the form of a hollow profile over at least one articulated lever 8. It is pivotably arranged on one of the articulated levers 8 with the axle 16. In this embodiment, the second fitting element 6 is not designed as a hinge cup but, as is usual for example for glass doors, as a fitting element with planar joint faces FIG. 6 shows this embodiment in the so-called closed position, in which the door 22 is closed. FIG. 7 shows an intermediate position, in which the damper is just coming into contact with the supporting area 19 of the support element 3 and is thereby activated, FIG. 8 shows the open position in which the door is open. The pivotably arranged support element 3 in this embodiment has a control contour 17, which serves to support the support element 3. In the variant shown here, the control contour 17 rests on a guide contour 18 formed on the fitting element 6. Both contours 17 and 18 are at least partially convex in form. The forms of the convexities 23 and 24 are selected such that the ram 2 comes into contact with the supporting area 19 due to the pivoting of the support element 3 at the desired closing angle between door 22 and side wall 25. Via a corresponding design of the contours 17 and 18, there is also a guarantee that the damping characteristics of the damper 1 can be optimally exploited and the maximum possible damping stroke can be realised It is immediately obvious to the person skilled in the art that the form of the contours 17 and 18 can be adapted to the respective damper and the respective hinge, in order to achieve the optimum of the desired damping characteristics. The support element 3 has, as in the other embodiments, the advantage that to achieve the optimum damping characteristics, it is not the form of the fitting elements or articulated lever which must be modified, but the support element 3 itself can be freely designed according to the desired specifications. When opening and closing, both the contours 17 and 18 and also the ram 2 and the support element 3 slide along each other. It would, however, also be possible to provide fixed rotational connections instead of a loose fit. Obviously it would also be possible, instead of two contours 17 and 18, also to provide only one correspondingly designed control contour 17. This could then rest on the fitting element, articulated lever or furniture part of ordinary design. Apart from this, there is also the possibility of providing a smooth, non-convex control contour 17 via a correspondingly convex or bulging design of the guide contour 18, since ultimately the decisive factor is the movement resulting from the interaction of the support element 3, which can be designed in the form of an additional structural component, and the supporting area 19 respectively.

In order to prevent the support element executing unnecessary movements or rattling, provision may be made to spring-load the support element, e.g. by a bow spring, not shown in detail here, which is connected with the support element 3 and preferably always forces this in the direction of the fitting element 6.

As is also the case in the other embodiments, it is also possible in the embodiment according to FIGS. 6 to 8 to fix the damper to the respective other fitting element. In a variation of FIGS. 6 to 8, in this variant the housing 20 of the damper 1 would then be arranged on the second fitting element 6, also executable as a hinge cup. The control contour 17 would then rest on the side of the hinge arm on a guide contour 18 which may be provided there.

Figure 11:
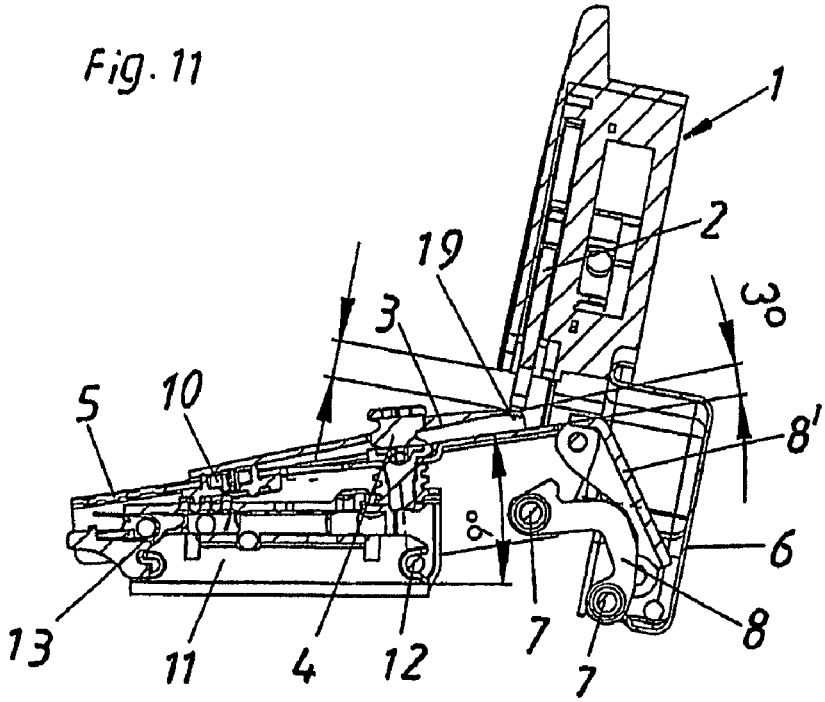
Figure 12:
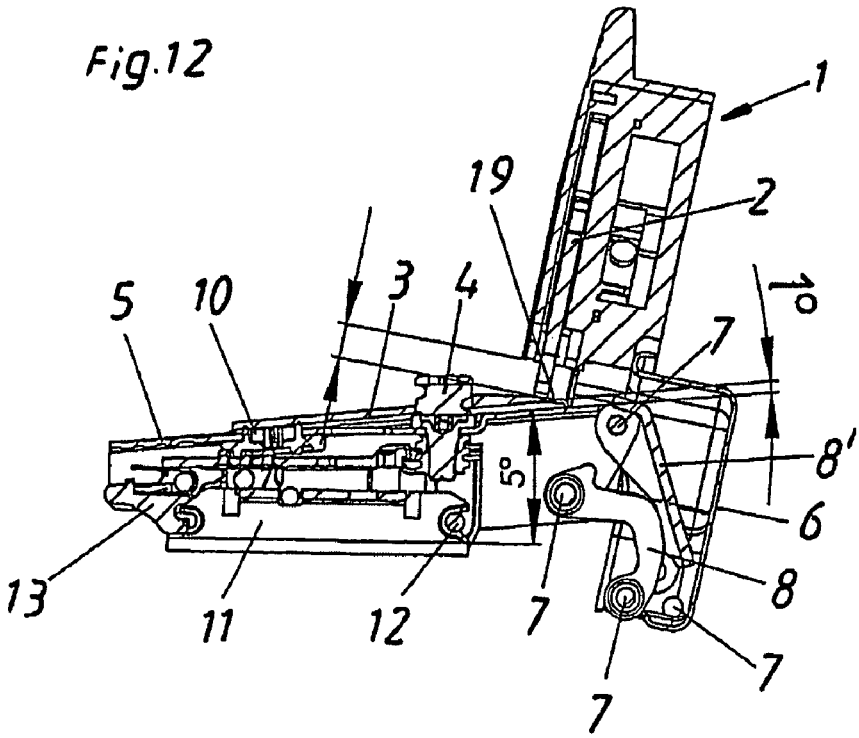

FIGS. 9 to 12 show an embodiment in which the position of the support element 3 is manually adjustable by means of an adjustment device 4. The support element 3 thereby remains fixed in the position once set during the relative movement between the fitting elements (hinge arm and hinge cup). The support element 3 is rotatably attached to an axle 16 and can be pivoted relative to the hinge arm 5. The adjustment device 4 can for example be designed as a simple adjustment screw. In the embodiment shown, however, the adjustment device 4 is realised in one structural unit with the joint adjustment device 15. To this end, the screw 4 has two areas 4' and 4" with different thread pitches. With the adjustment device 4 and the support element 3, it is possible to equalise a relative position between the two fitting elements 5 and 6 which has been modified by the depth adjustment device 10 and/or the joint adjustment device 15 in such a way that the same damping function of the damper exists as before the adjustment by the depth adjustment device or the joint adjustment device. Thus it is possible to adjust the damping function at least within certain limits, independently of the relative position of hinge cup 6 to hinge arm 5. One example of this is shown in FIGS. 11 and 12. By corresponding adjustments of the joint adjustment screw 4, the upper edge of the hinge arm 5 is at an angle of 9° relative to the base plate 11 in FIG. 11. An angle of 3° is set between said upper edge of the hinge arm 5 and the support element 3. If the angle between base plate 11 and upper edge of the hinge arm 5 is now reduced to 5° (see FIG. 12), then the combined adjustment device 4 automatically lowers the support element 3 to an angle of 1° relative to the upper edge of the hinge. The result of this is that in both cases the ram 2, the fitting elements being at the same angle with respect to each other, comes into contact with the support element 3 and then is immediately forced deep into the cylinder of the damper 1. The same damping function is thus exercised in both positions.

As the individual embodiments show, by using a correspondingly designed support element, an optimum damping path can be achieved for dampers known in the state of the art. This is especially advantageous in arrangements or hinge types in which the articulated levers are only moved very slightly in the last 20° of the closing movement, as the result of which a sufficient damping path cannot be achieved without the inventive support element.

Even when inventive damper arrangements are shown in the embodiments integrated in hinges, it is still possible to design damper arrangements according to the invention detached from hinges. In the case of hinges, the damper 1 and also the support element 3 can each be arranged on both fitting elements 5 and 6. Naturally, the inventive damper arrangement can also be combined with any other hinge, thus not only with hinges with hinge arm and hinge cup.

The invention claimed is:

1. A damper arrangement for moveable furniture parts, comprising:

a first fitting element and a second fitting element to be fastened to the furniture parts, respectively;

a damper coupled to said first fitting element, said damper having a damper housing and a ram which can be subjected to pressure, said ram being displaceable with respect to said damper housing;

a first articulated lever and a second articulated lever, said first and second fitting elements being coupled to each other by said first and second articulated levers; and a support element arranged to support said ram only by direct contact between surfaces of said support element and said ram, said support element being arranged so as to be movable relative to said ram and relative to said first and second fitting elements in response to movement of the damper arrangement between a first end position and a second end position, wherein said surfaces of said ram and said support element are not directly connected to each other, wherein said support element is arranged so as to be slidable along an outer surface of said second fitting element, wherein an inner surface of said second fitting element is configured to be fastened to a corresponding one of the furniture parts, said outer surface and said inner surface being on opposite sides of said second fitting element, and wherein said first articulated lever, said second articulated lever and said support element are separate components of the damper arrangement.

2. A damper arrangement according to claim 1, wherein said ram is supportable so as to slide along said support element in response to movement of the damper arrangement between the first end position and the second end position.

3. A damper arrangement according to claim 1, wherein said support element is mounted so as to be rotatable about an axle.

4. A damper arrangement according to claim 1, wherein said support element has a control contour, said support element being arranged to rest along said control contour, whereby said support element is displaceable or slidable or pivotable due to said support element resting along said control contour.

5. A damper arrangement according to claim 4, wherein said control contour is shaped so as to slidably support said support element.

6. A damper arrangement according to claim 4, wherein the damper arrangement has a guide contour to be disposed on a furniture part, and wherein said control contour is supportable on said guide contour.

7. A damper arrangement according to claim 4, wherein said control contour includes at least one bulging portion.

8. A damper arrangement according to claim 1, wherein the damper arrangement has a guide contour to be disposed on a furniture part so as to support said support element, whereby due to the support of said support element on said guide contour said support element is displaceable or slidable or pivotable.

9. A damper arrangement according to claim 8, wherein said guide contour is shaped to slidably support said support element.

10. A damper arrangement according to claim 8, wherein said guide contour includes at least one bulging portion.

11. A damper arrangement according to claim 1, wherein said damper is arranged to execute a maximum possible damping stroke during movement of the damper arrangement between the first end position and the second end position.

12. A hinge having a damper arrangement according to claim 1.

13. A hinge according to claim 12, wherein one of said first and second articulated levers includes at least one articulated axle, and wherein said support element is coupled to said one of said first and second articulated levers or to said second fitting element.

14. A hinge according to claim 13, wherein said support element is pivotably mounted on one of said first and second fitting elements.

15. A hinge according to claim 13, wherein said first fitting element is a hinge arm.

16. A hinge according to claim 12, wherein said support element is pivotably mounted on one of said first and second fitting elements and is supportable on the other of said first and second fitting elements.

17. A damper arrangement according to claim 1, wherein said support element and said ram are arranged such that said surfaces of said support element and said ram are spaced apart from each other in the first end position and are in direct contact with each other in the second end position.

18. A damper arrangement according to claim 1, wherein said support element is pivotably connected to one of said first and second articulated levers.

19. A damper arrangement for moveable furniture parts, comprising:

a first fitting element and a second fitting element to be fastened to the furniture parts, respectively;

a damper coupled to said first fitting element, said damper having a damper housing and a ram which can be subjected to pressure, said ram being displaceable with respect to said damper housing;

an articulated lever arranged so as to couple said first and second fitting elements to each other; and a support element pivotably connected to said articulated lever, said support element being arranged to support said ram only by direct contact between surfaces of said support element and said ram, said support element being arranged so as to be movable relative to said ram and relative to said first and second fitting elements in response to movement of the damper arrangement between a first end position and a second end position, wherein said surfaces of said ram and said support element are not directly connected to each other, wherein said support element is arranged so as to be slidable along an outer surface of said second fitting element, wherein an inner surface of said second fitting element is configured to be fastened to a corresponding one of the furniture parts, said outer surface and said inner surface being on opposite sides of said second fitting element.

* * * * *